US008424434B2

(12) United States Patent
Koegel et al.

(10) Patent No.: US 8,424,434 B2
(45) Date of Patent: Apr. 23, 2013

(54) UNIVERSAL FENCE FOR A POWER TABLE SAW

(75) Inventors: Jan Koegel, Arlington Heights, IL (US); Uwe Striggow, Aichtal (DE)

(73) Assignee: Robert Bosch GmbH, Stuttgart (DE)

( * ) Notice: Subject to any disclaimer, the term of this patent is extended or adjusted under 35 U.S.C. 154(b) by 395 days.

(21) Appl. No.: 12/431,328

(22) Filed: Apr. 28, 2009

(65) Prior Publication Data

US 2010/0269657 A1 Oct. 28, 2010

(51) Int. Cl.
*B27B 27/10* (2006.01)

(52) U.S. Cl.
USPC ..... 83/477.2; 83/581; 83/477; 83/471

(58) Field of Classification Search ..... 83/471, 83/446, 477, 581, 477.2
See application file for complete search history.

(56) References Cited

U.S. PATENT DOCUMENTS

| | | | | |
|---|---|---|---|---|
| 4,408,509 | A * | 10/1983 | Winchip | 83/435.27 |
| 5,116,249 | A * | 5/1992 | Shiotani et al. | 83/435.14 |
| 5,181,503 | A | 1/1993 | Fish et al. | |
| 5,970,835 | A | 10/1999 | Kenyon et al. | |
| 6,679,305 | B2 * | 1/2004 | Petersen | 144/253.1 |
| 6,688,202 | B2 * | 2/2004 | Parks et al. | 83/435.27 |
| 2002/0108480 | A1 | 8/2002 | Hewitt et al. | |
| 2002/0134212 | A1 | 9/2002 | Ceroll et al. | |
| 2002/0194971 | A1 * | 12/2002 | Park et al. | 83/477.2 |
| 2003/0033920 | A1 * | 2/2003 | Parks et al. | 83/440 |
| 2005/0139056 | A1 * | 6/2005 | Gass et al. | 83/438 |
| 2006/0075862 | A1 * | 4/2006 | Parks et al. | 83/451 |
| 2008/0083106 | A1 | 4/2008 | Elsworthy | |
| 2008/0092707 | A1 | 4/2008 | Aigner | |

FOREIGN PATENT DOCUMENTS

| | | |
|---|---|---|
| CA | 2197633 | 9/1997 |
| DE | 29804443 | 8/1998 |
| DE | 29825070 | 10/2004 |
| DE | 10348587 | 3/2005 |
| EP | 1832367 | 9/2007 |
| EP | 1859884 | 11/2007 |
| GB | 2339404 | 1/2000 |
| WO | WO 01/98043 | 12/2001 |
| WO | WO 2004/050315 | 6/2004 |

* cited by examiner

*Primary Examiner* — Sean Michalski
(74) *Attorney, Agent, or Firm* — Maginot, Moore & Beck

(57) ABSTRACT

Embodiments of the present invention comprise a fence for a power saw having a table top with generally vertical front, rear and opposite side surfaces, at least one side surface having an elongated side element extending from a front portion toward said rear surface, said side element having a cross section defining a vertical groove with an inner vertical surface that merge into upper and lower opposed extensions that define upper and lower undercuts, said fence comprising an elongated fence member having a generally vertical front planar surface for engaging a work piece, a table extension having a top surface area coextensive with said saw table top and operatively connected to said fence member, said extension providing support for a work piece that extends beyond a side of the table top surface, said fence being configured so that the front planar surface can be positioned in front of the vertical front surface of the saw, i.e., off of the top surface.

22 Claims, 11 Drawing Sheets

UNIVERSAL FENCE FOR A POWER TABLE SAW

BACKGROUND OF THE INVENTION

The present invention generally relates to power table saws and more particularly to fences for use with such saws.

Power saws of the type that have a saw blade that extends through an opening in the top surface of the saw are commonly known as table saws and typically have the ability to adjust the angle of the saw blade to provide bevel cuts on work pieces that are placed on the tabletop surface. Such saws also can adjust the height that the saw blade extends above the top surface. It is also a practical necessity for fences to be used with such saws and such fences are generally characterized as either miter fences or rip fences. The rip fences are generally removable and can also be adjustably positioned relative to the blade and usually extend from the front to the rear of the table top and are oriented in a direction parallel to the plane of the saw blade.

Miter fences generally have a lower extension that fits in a slot in the table top that is parallel to the plane of the blade and have a front fence surface that can be used to push the work piece through a cutting region adjacent to the cutting blade.

There are universal fences that are commercially marketed that perform the function of a miter fence as well as a rip fence and are particularly useful for table saws that are known as push-pull saws that are more prevalent in European markets than in the United States. This particular type of saw has a cutting blade that is mounted to a carriage assembly that rides along guide rails, elongated rods or the like underneath the saw table top, with the blade extending upwardly through an elongated slot. The blade can be vertically adjusted as well as angularly adjusted for bevel cuts and can be operated in the same manner as conventional table saws commercialized in the United States where a work piece is moved along the table top to engage the blade and make a cut.

The push-pull saw can also be operated in a manner wherein the user can manually pull a handle or knob to move the saw blade and carriage assembly from the rear part of the slot forwardly to make cuts on a work piece that is placed at a stationary position on the table top.

Universal fences used with such push-pull saws are generally mounted on saw table top near the front of the saw to hold the work piece in place. When the knob is pulled toward the front, the saw blade is brought into cutting position to cut through the work piece. Because the saw blade and its undercarriage generally slide along guide rails or rods, the blade is very stable and makes very accurate cuts in a work piece. Such saws are favored by many European trim carpenters and artisans who require precise cuts in their work.

Many currently available universal fences limit the effective size of a push-pull table top in that there is insufficient table top surface area for larger work pieces and the fact that they can be locked in only one or a relatively few positions on the table top. Moreover, because they are often fixed in those few positions, they do not permit the convenient sliding function found on many miter saw designs that are currently available in the United States.

Embodiments of the present invention provide support for larger work pieces and also have the capability of moving the fence to move work pieces relative to the blade through the cutting region.

SUMMARY OF THE INVENTION

Embodiments of the present invention comprise a fence for a power saw having a table top with generally vertical front, rear and opposite side surfaces, at least one side surface having an elongated side element extending from a front portion toward said rear surface, said side element having a cross section defining a vertical groove with an inner vertical surface that merge into upper and lower opposed extensions that define upper and lower undercuts, said fence comprising an elongated fence member having a generally vertical front planar surface for engaging a work piece, a table extension having a top surface area coextensive with said saw table top and operatively connected to said fence member, said extension providing support for a work piece that extends beyond a side of the table top surface, said fence being configured so that the front planar surface can be positioned in front of the vertical front surface of the saw, i.e., off of the top surface.

Other preferred embodiments are described in the specification.

DETAILED DESCRIPTION

The embodiments of the present invention illustrated and described herein are directed to a universal fence that is designed and configured to be used with not only a push-pull type of power table saw, but other types of power table saws, such as conventional table saws that are marketed in the United States. The fence is adjustable in many respects which contributes to its superior functionality and usefulness, both in being able to slide from front to rear and thereby push work pieces through the cutting area of a table saw, but can also to position and hold work pieces on the table top surface to enable the saw to make extremely accurate straight as well as angled cuts on work pieces that are placed on the table top surface.

The fence has the capability of being attached to the table saw, which by virtue of its superior design and configuration, has a table top extension that is part of the fence. The extension increases the effective size of the table top and thereby enables larger work pieces to be supported during cutting. Moreover, the extension enables the fence member that contacts the work piece to be positioned in front of the front edge of the table top and thereby effectively increases the size of the table top for supporting larger work pieces. The use of clamping mechanisms with regard to many of the components of the fence facilitates extreme flexibility and adjustment which maximizes its utility and usefulness.

Figure 1:
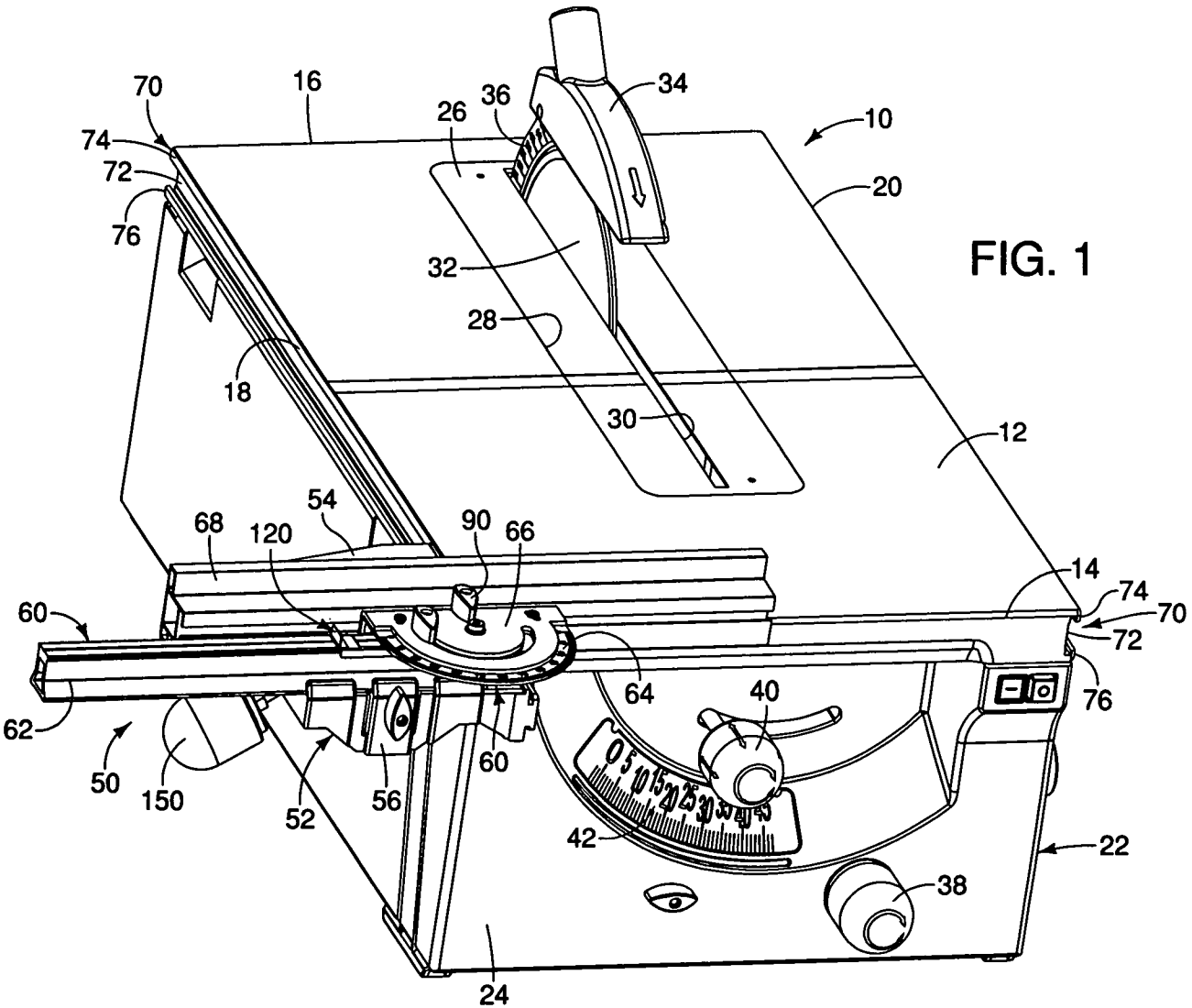
FIG. 1 is a left front elevated perspective view of a table saw of the push-pull type which has a preferred embodiment of a universal fence attached to the left front thereof.
Figure 2:
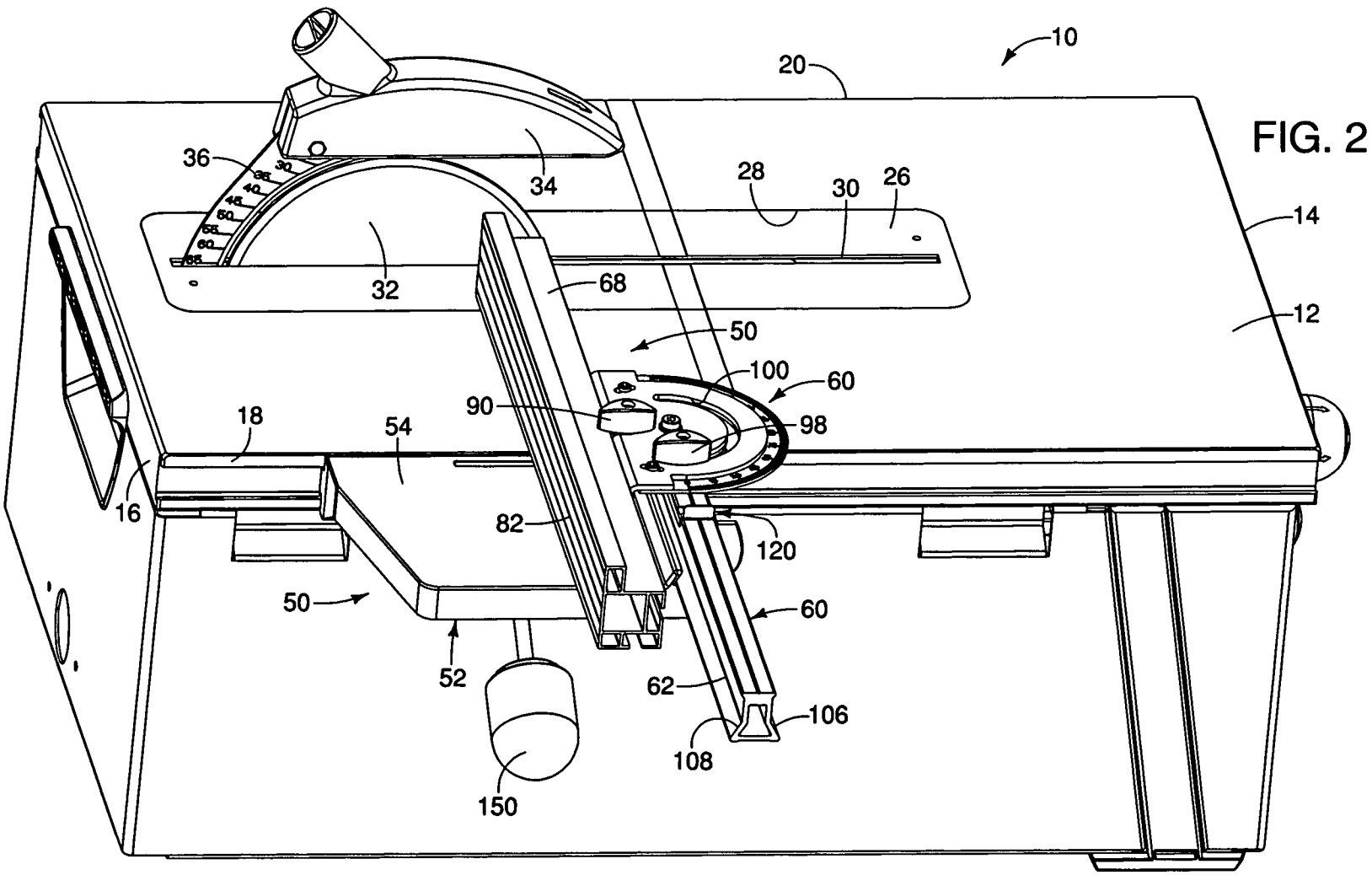
FIG. 2 is a left side elevated perspective view of the table saw shown in FIG. 1 and illustrating the preferred embodiment of the universal fence shown at a rearward position on the table surface.

Turning now to the drawings, and particularly FIGS. 1 and 2, a push-pull type table saw is indicated generally at 10 which has a table surface 12 that is generally rectangular in shape, with a front vertical surface 14, a rear vertical surface 16, a left side vertical surface 18, and a right side vertical surface 20. The saw has a base frame, indicated generally at 22, that includes a front 24 and has a table top insert 26 that fits within a recess 28, with the insert 26 having a slot 30 through which a blade 32 extends. The blade has a blade guard 34 that is supporting by a riving knife 36 that is mounted on a carriage mechanism (not shown) that supports a drive motor and gear arrangement and the blade, and the carriage mechanism is mounted for sliding movement on elongated rails, rods or the like. The movement of the carriage mechanism is controlled by a mechanism that is connected to a front knob 38 that an operator can pull to move blade forwardly from the position shown in FIG. 1 preferably through the full length of the slot 30.

The construction and operability of the push-pull fence is not in and of itself a part of the present invention except insofar as it has a fence in which the embodiments of the present invention are particularly suited for use with. The saw 10 is also capable of making angled cuts on a work piece and to this end a rotatable knob 40 can be used to adjust the angle of the plane of the blade from the 90° or vertical position shown in FIG. 1 to an angled orientation that is shown in a gauge 42 that indicates it can be adjusted to about a 45° angle.

A first preferred embodiment of the universal fence of the present invention is indicated generally at 50. As best shown in FIGS. 1, 2, 4 and 6, the fence comprises a main body, indicated generally at 52, which is preferably an aluminum casting which forms a table extension 54 that extends from a holding mechanism portion 56 that is located on the opposite or forward end of the mechanism. In this regard, the use of the term "forwardly" is intended to mean in the direction toward the front surface 14 of the saw. The holding mechanism portion 56 is designed and configured to hold an elongated fence assembly, indicated generally at 60, which comprises an elongated rail member 62, a miter base 64 and a miter frame mounted on the miter base 64. An elongated fence member 68 is slidably attached to the miter frame 66.

As is best shown in FIG. 1, the saw table top 12 has a grooved rail 70 located along the left side 18 as well as the right side 20. The rail defines a captive groove 72 having a main opening, with the rail having upper and lower vertical extensions 74 and 76 which define upper and lower undercut portions of the groove in which the fence engages to be held to the table 10.

Figure 6:
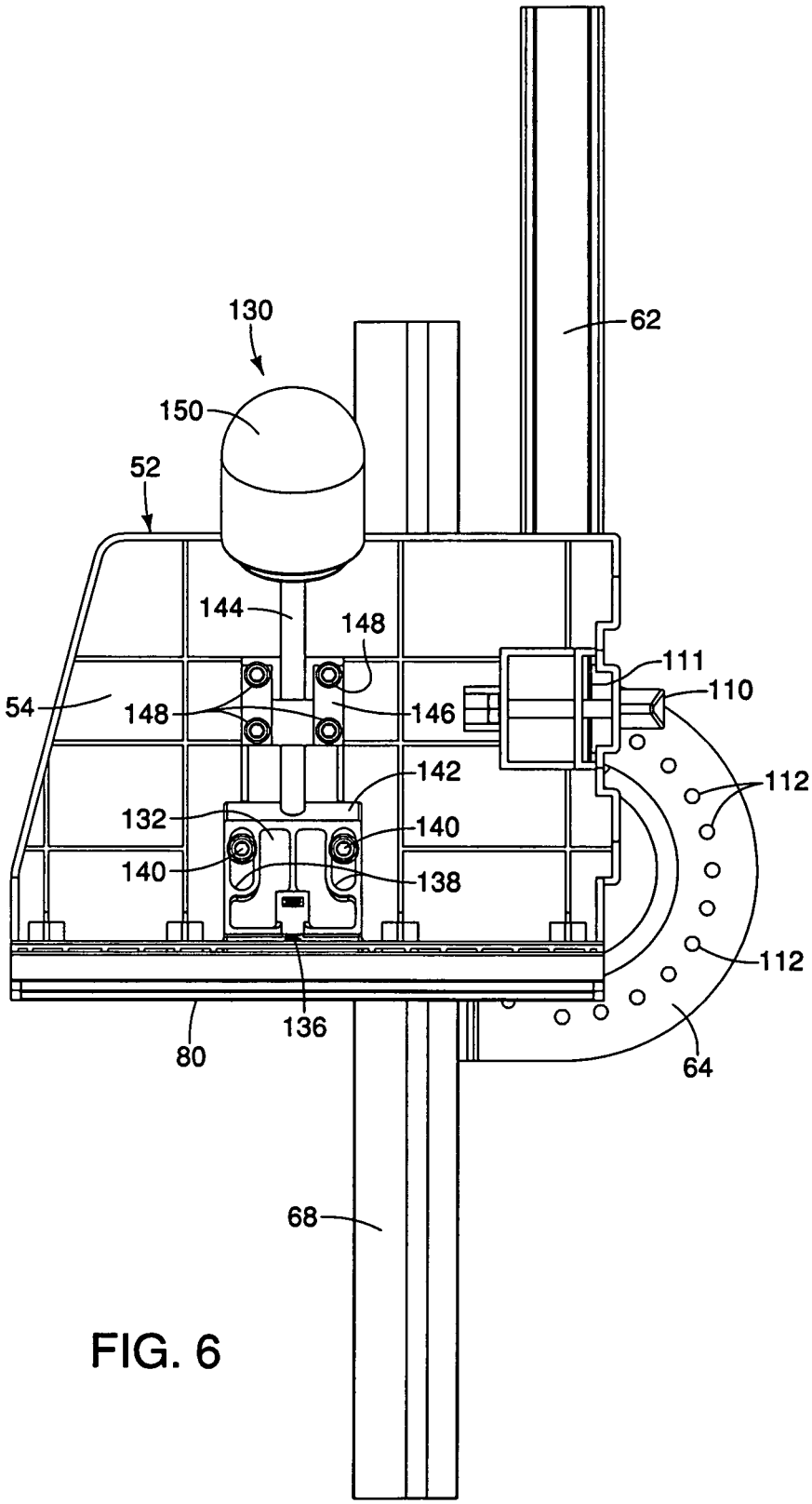
FIG. 6 is a bottom view of the universal fence shown in FIG. 1.
Figure 7:
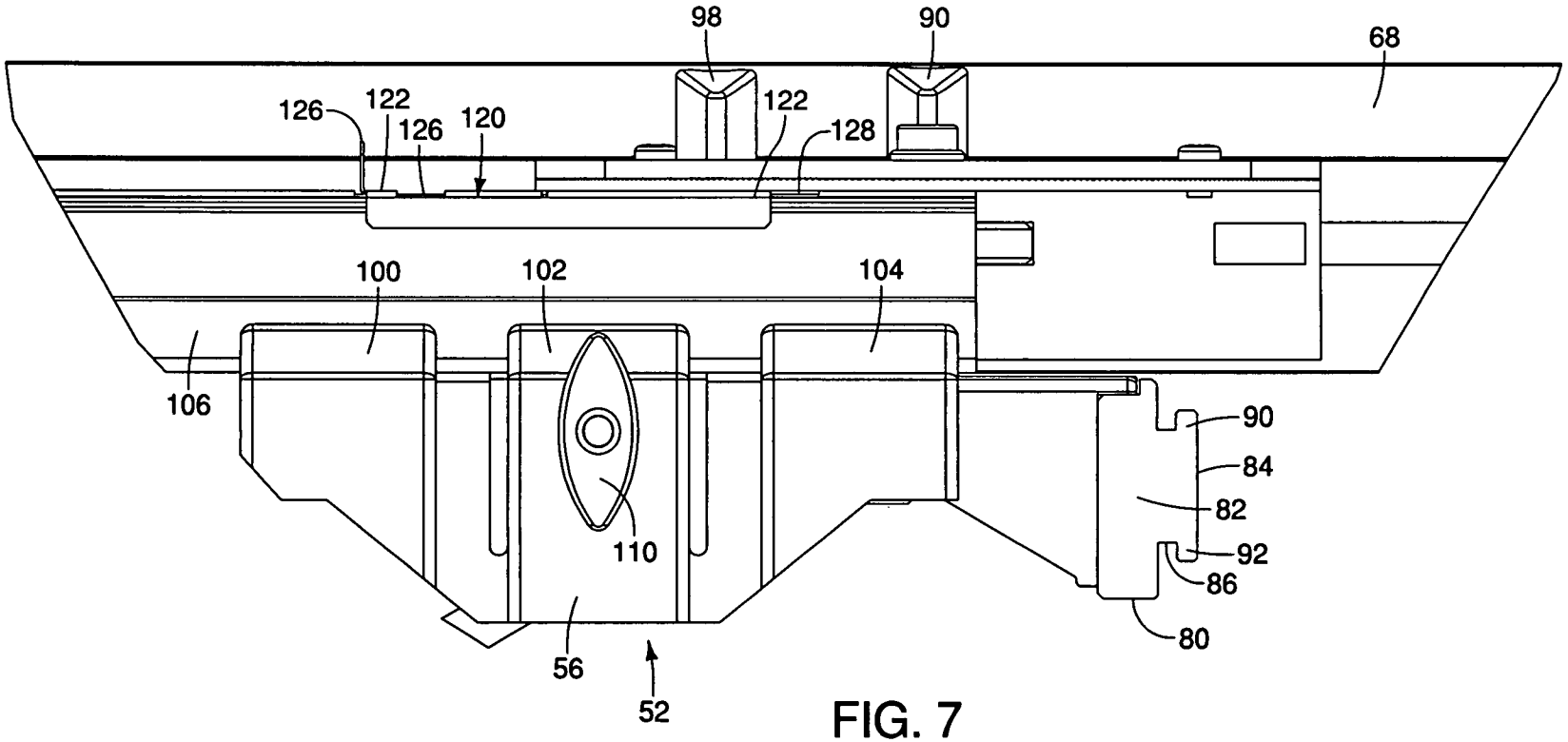
FIG. 7 is a left plan view of the universal fence shown in FIG. 1, particularly illustrating a detent mechanism override.

In this regard, and referring to FIG. 7, the body 52 has a slide element 80 attached thereto which preferably extends along the entire length of the body from the front surface to the opposite end of the extension 54 as shown in FIG. 6. The configuration of the slide element 80 has a main portion 82, an outer portion 84 and a narrower intermediate portion 86 which together define upper and lower flanges 90 and 92 which engage the upper and lower undercuts of the captive groove 72 defined in the rail 70. The slide element 80 is preferably made of a strong plastic or plastic-like material that has a relatively low coefficient of friction, high strength and durability, such as Kevlar, for example. The slide element 80 is preferably attached to the body 52 with screws or similar fasteners, but may be adhesively attached. One consideration is that if it becomes worn and needs to be replaced, it should be capable of being disassembled and replaced without damaging the body 52. It should also be understood that the rail 70 may be a metal extrusion, such as steel or aluminum that may be mounted to the side of the table, or it may be formed in the table top.

Figure 4:
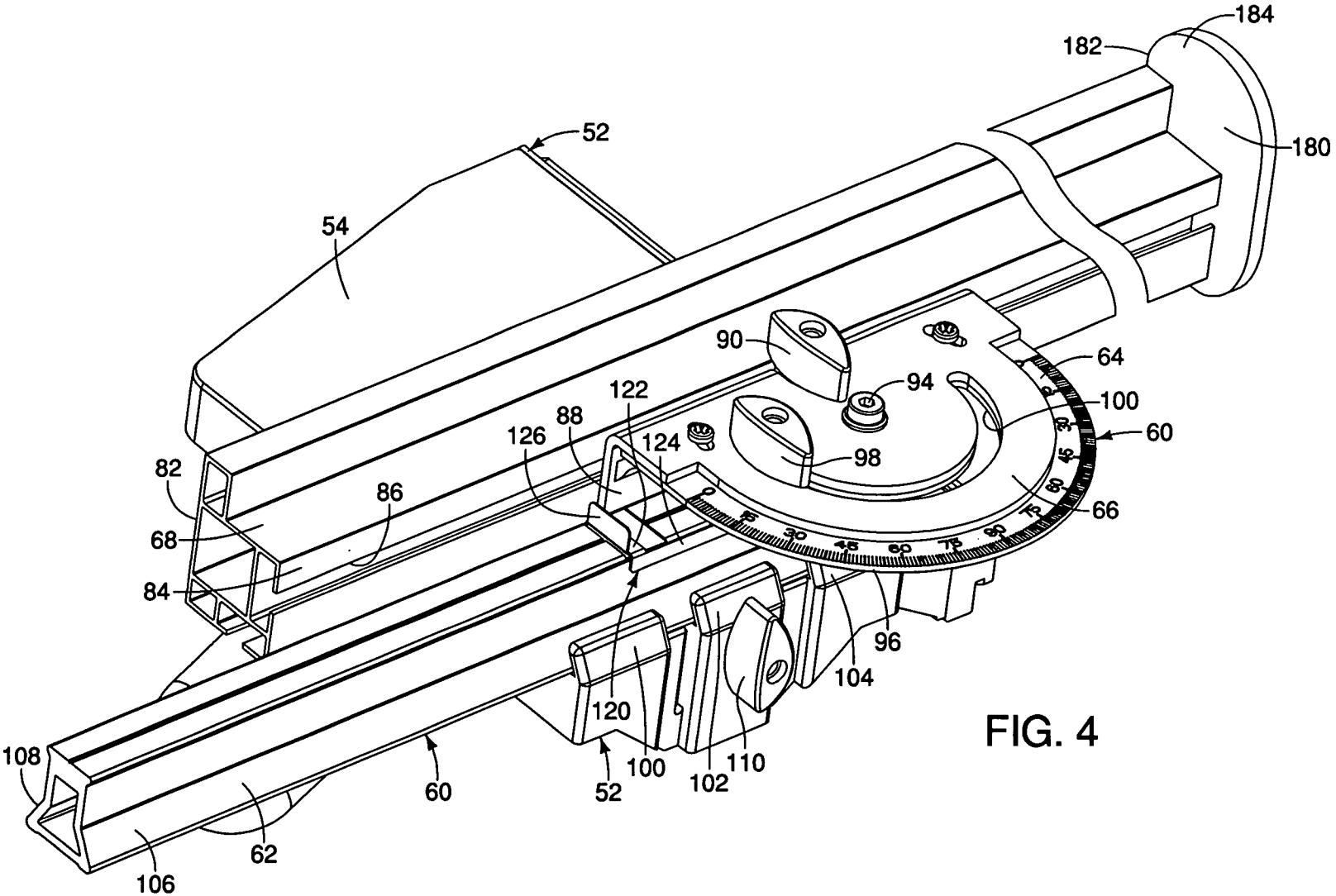
FIG. 4 is an elevated perspective view of the universal fence shown in FIG. 1.
Figure 11:
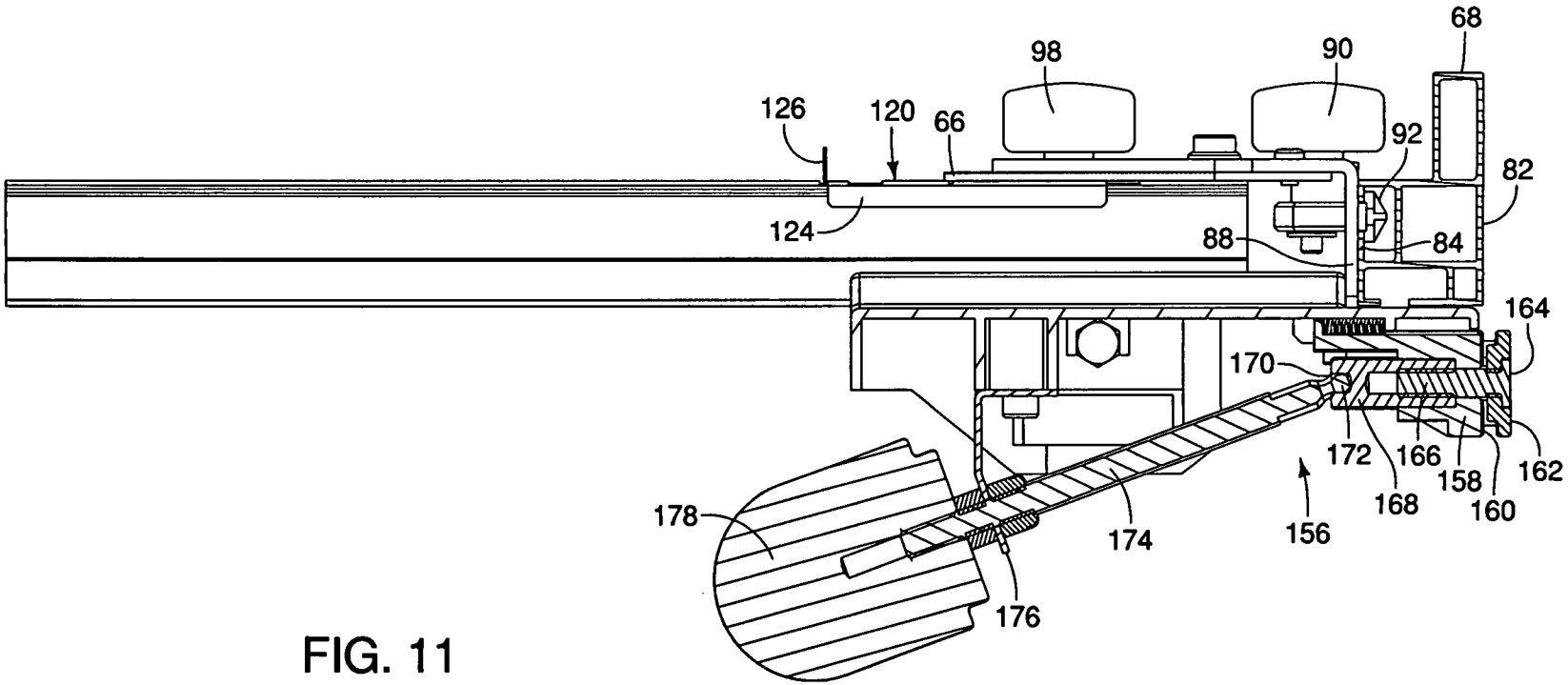
FIG. 11 is a front view of the second preferred embodiment shown in FIG. 9, partially in section, but illustrating another locking mechanism.

The fence member 68 is slidably retained by the elongated fence assembly 60 and to that end, as best shown in FIGS. 4 and 11, the fence member 68 is preferably an aluminum extrusion having a rear wall 84 in which a longitudinal slot 86 is formed. The miter frame 66 has a downwardly turned front face portion 88 that is preferably angled at 90° relative to the plane of the horizontal portion 66 and a clamping mechanism comprised of rotatable handle 90 pulls a clamp member 92 that is appropriately sized larger than the width of the slot 86 to pull the rear wall 84 into tight clamping contact with the front face portion 88 of the miter frame 66. Thus, rotating the handle 90 to loosen the clamp member 92 enables the fence member 68 to be slidably adjusted relative to the elongated fence assembly 60.

An important consideration of the use of the slide element in the captive groove 72 defined by the rail 70 is the fact that the slide element is attached to the table extension 54 and provides support for the fence from the front surface of the body portion 52 to the rear edge of the table extension 54. This is significant for the reason that as shown in FIG. 1, the fence 50 can be moved to the extreme front of the fence as shown in FIG. 1 wherein the front face of the fence member 68 may be located beyond the front edge 14 of the table top and still be in position to engage a work piece that is placed on the fence. In other words, the front face of the fence member 68 may be located in space in front of the front edge 14 of the table top. This effectively increases the useful size of the tabletop 12 compared to many fence designs which must have a fence element resting on the table top surface.

Figure 9:
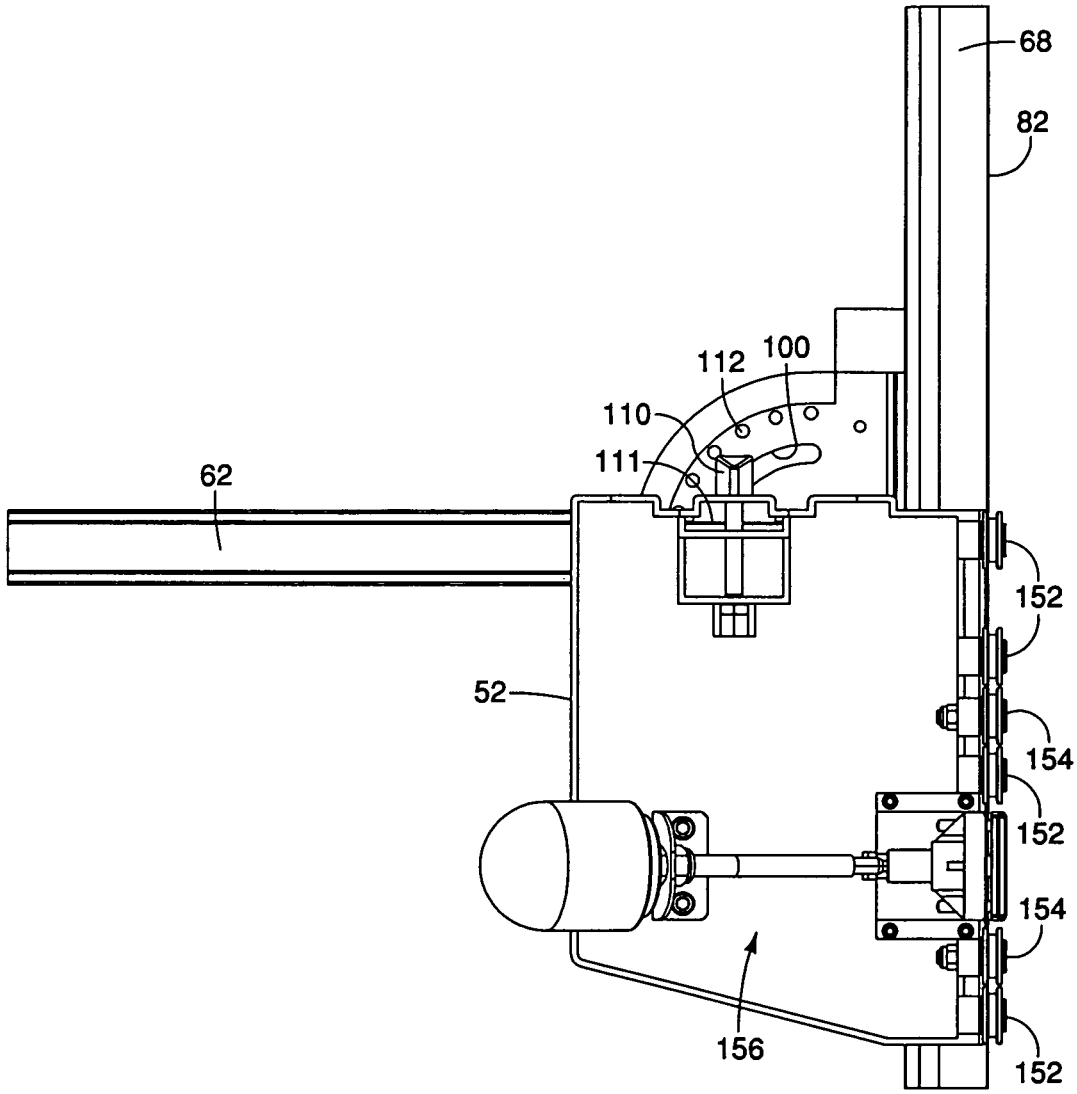
FIG. 9 is a bottom view illustrating a second preferred embodiment of a universal fence.

It should also be appreciated that with the sliding engagement of the slide element 80 in the rail 70, a work piece can be placed with the fence in the extreme forward position and can be pushed toward the rear to perform a cut by the saw blade 32. Another capability of the fence 50 is the angular adjustment of the fence member 68 relative to the orientation of the rail 70. While most of the drawings have the fence member 68 parallel to the elongated rail member 62, as shown in FIGS. 1-6, the elongated fence assembly 60 permits the fence member 68 to be adjusted to be perpendicular to the elongated rail member 62 as shown in FIG. 9.

Figure 3:
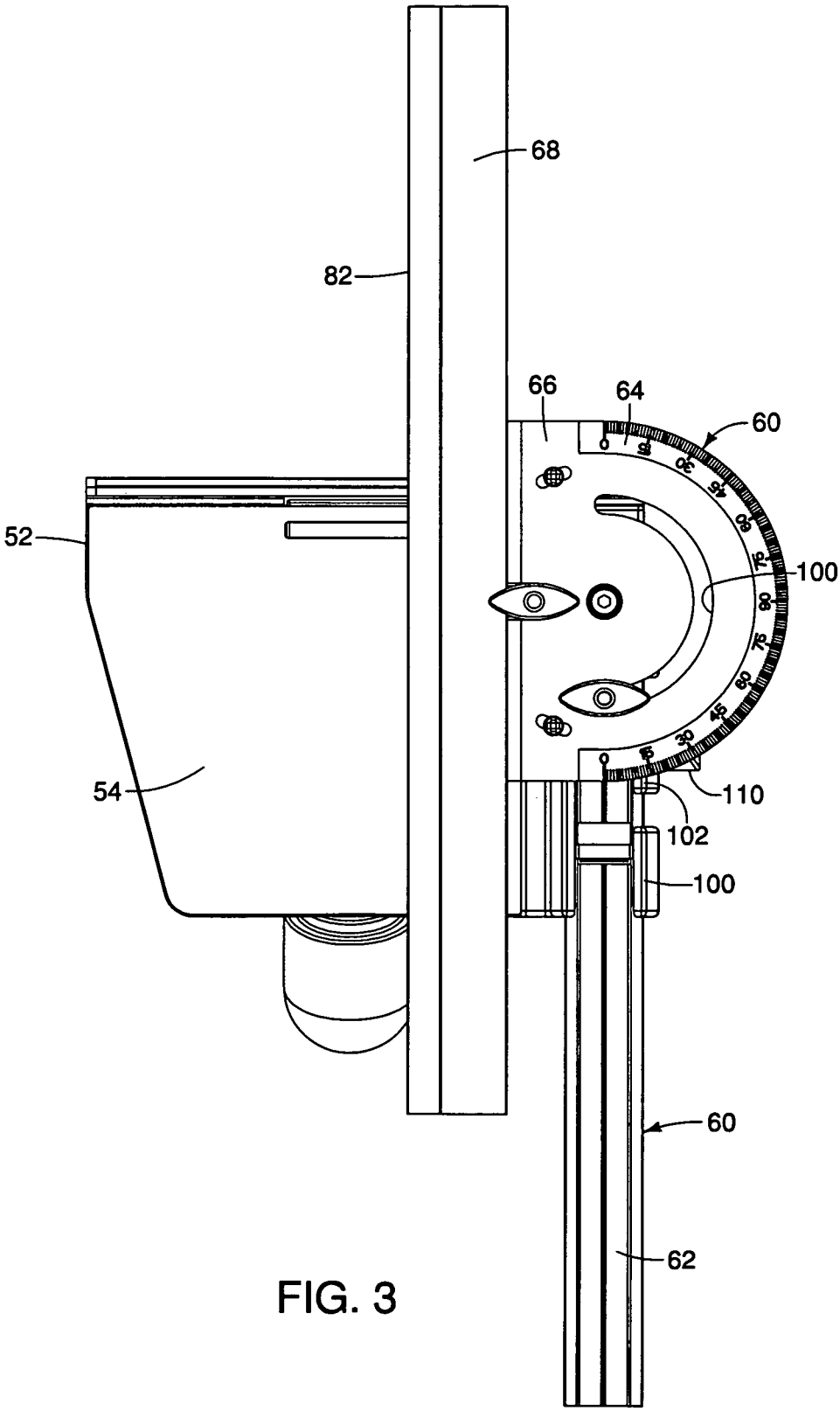
FIG. 3 is a top plan view of the embodiment of the universal fence shown in FIG. 1.

With regard to rotating the angle of the fence member 68, and referring to FIGS. 3 and 4, the miter frame 66 and the miter base 64 are pivotable about a pivot connection 94 that comprises a bolt that extends through the miter base 64 and the miter frame 66 and screws into the elongated rail member 62. As shown in FIG. 4, the miter base 64 has indicia 96 that indicates the angular orientation of the front face 82 of the fence member 68 and as shown in FIG. 4, the top of the elongated rail member 62 has a center line that is aligned with the zero mark on the miter base 64.

The elongated fence assembly 60 also has another clamping handle 98 which is also screwed into a threaded aperture of the elongated rail member 62 and it also rides in an annular slot 100 located in both the miter base 64 and miter frame 66, which when loosened enables the miter base 64, miter frame 66 and the fence member 68 to be rotated in the clockwise direction as viewed from above in FIG. 4 to a position that extends to 90° and then in the opposite direction back toward zero. It is contemplated that the fence 50 can also be mounted in the right side 20, rail 70 of FIG. 1.

As is best shown in FIGS. 4, 6 and 7, the body 52 has three upwardly directed angular portions 100, 102 and 104 which are angled to be parallel to an angled base portion 106 of the elongated rail member. While not shown, the body 52 has a similar angled surfaces for engaging an angled base portion 108 located on the opposite side of the base portion 106. A clamping handle 110 has a threaded post that is screwed into the body 52 and engages a clamping plate 111 (see FIG. 6) so that tightening the handle 110 causes the plate 111 to be tightened into engagement with the elongated rail member 62 to hold it. When it is loosened, the rail member 68 can be slidably adjusted relative to the body 52.

Figure 8:
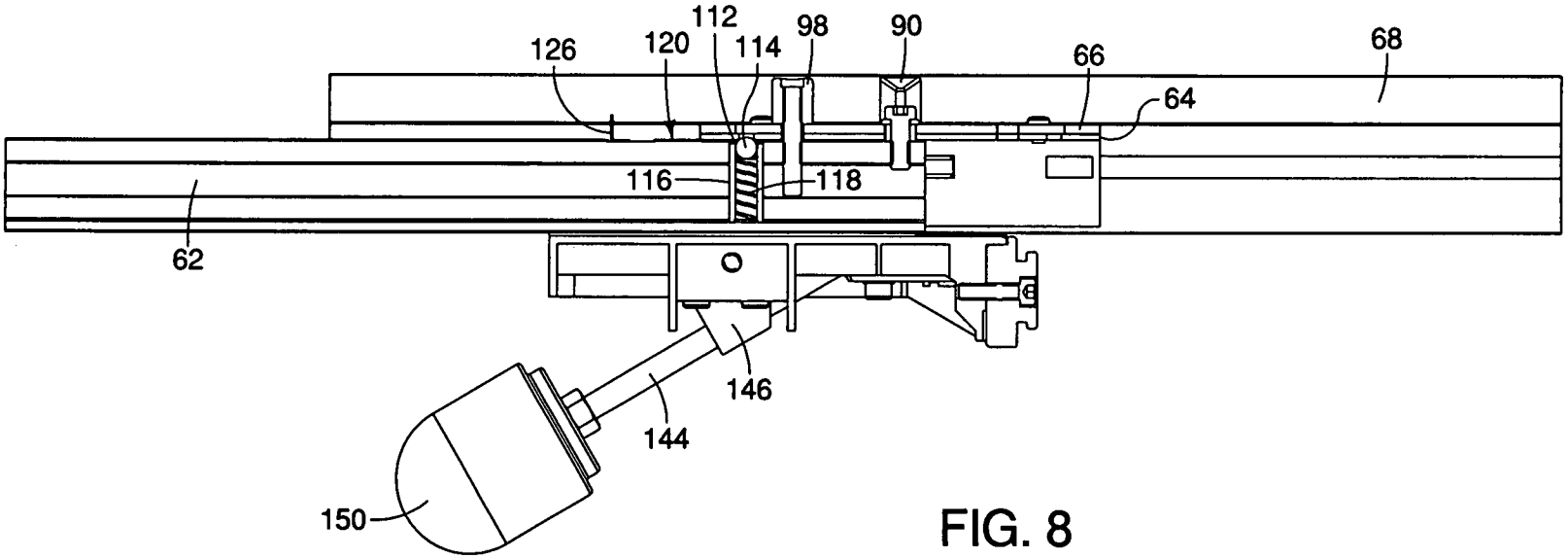
FIG. 8 is a side view of the universal fence shown in FIG. 1 and partially in cross section and particularly illustrating a detent mechanism.

The miter angular adjustment capability of the miter base 64 and the miter frame 66 is also provided with a detent mechanism that enables a user to loosen the handle 98 and quickly rotate the miter base 64 and frame 66 to predetermined angular positions which are accurately and quickly set. Referring to FIGS. 6 and 8, the miter base 64 has a number of apertures 112 which are shown to be at 5° increments which correspond to the indicia on the miter base 64 shown in FIG. 3. The apertures are sized to receive a ball 114 (see FIG. 8) which is contained within a vertical sleeve 116 and which includes a compression spring 118. The ball has a diameter that is larger than the diameter of the apertures 112 so that the ball only penetrates a distance sufficient to retain the angular position that is defined by the location of the particular aperture 112 in which the ball 114 seats. Thus, a user can merely rotate the fence member 82 and feel it snap from angular position to angular position and by viewing the indicia on the miter base can quickly change the angle of the fence member to a desired one.

However, it should be understood that there may be special angles that require specific angular positioning and the detent mechanism can interfere with such positioning, particularly when the angle very close to one of the predetermined angles. For this reason, the preferred embodiment of the present invention includes a detent mechanism override for selectively disabling the detent mechanism. This override mechanism is best shown in FIGS. 4, 7 and 11 and includes a detent override slide, indicated generally at 120 which comprises an elongated member having a top portion 122, downwardly depending sides 124 and a gripping portion 126.

As best shown in FIG. 7, the detent override slide 120 rides on the top of the elongated rail member 62 which has a pair of recesses 126 and 128 in the top thereof, and which have a depth that corresponds to the thickness of the top portions 122 and a length that enables the slide 120 to be moved into and out of disabling engagement of the detent mechanism. In this regard, the rightward end of the top portion 122 shown in FIGS. 7 and 8 is positioned to be moved from the position shown in FIGS. 7 and 8 to the right wherein the top rightward portion 122 will engage the ball 114 and push it downwardly thereby disabling the ball from engaging any of the apertures 112 in the miter base 64. This enables the angular position to be set by a user at any desired position wherein tightening of the handle 98 will lock the angular position in place as is desired. As is evident from FIGS. 1 and 2, the detent mechanism override slide is eminently visible and its use is intuitively obvious.

Figure 5:
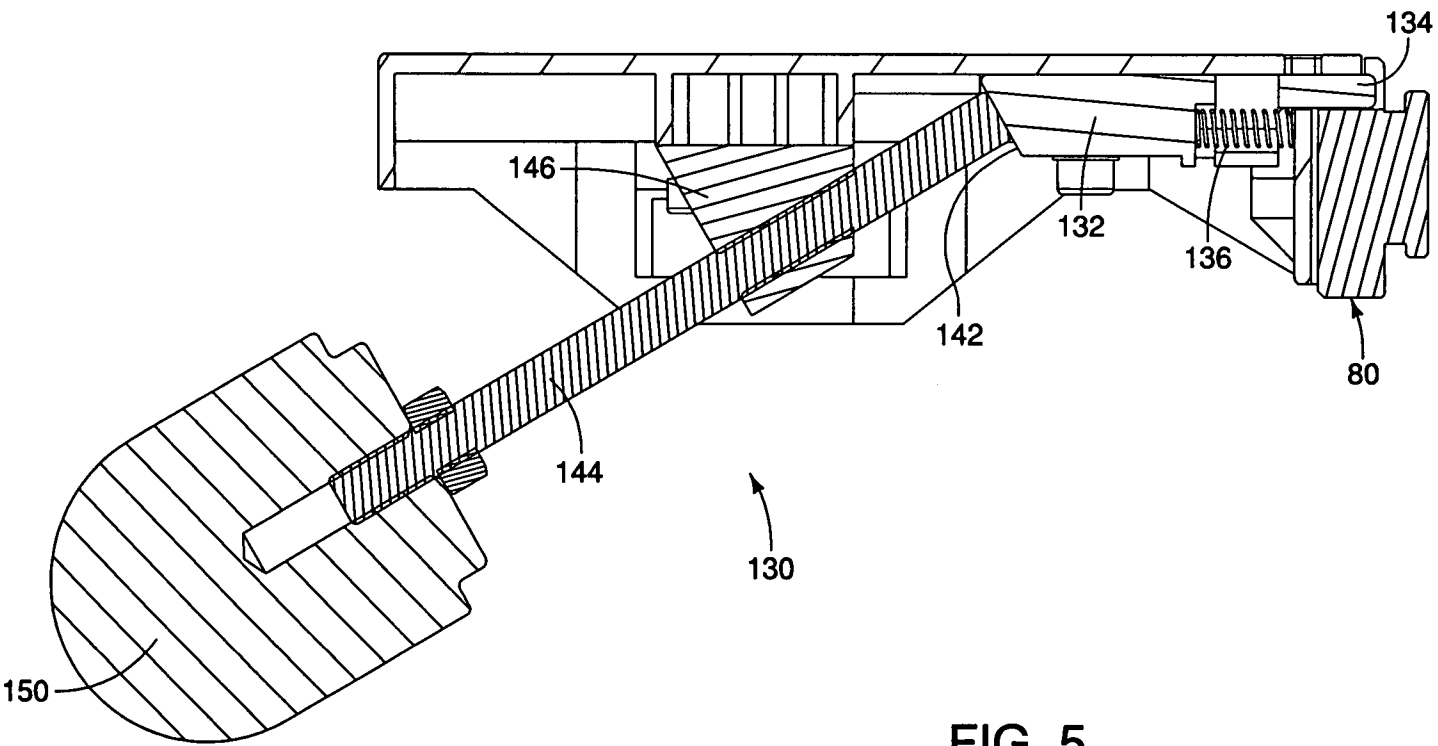
FIG. 5 is a front plan view of a portion of the universal fence shown in FIG. 1, partially in section, and particularly illustrating a locking mechanism.

To lock the fence 50 in the captive groove 72, the fence has a clamping mechanism, indicated generally at 130, in FIGS. 5 and 6. With this embodiment, a short section of the slide element 80 is removed so that a slidable plate 132 which has a front surface 134 is in position to engage the upper extension 74 of the rail 70. A compression spring 136 is provided to bias the slidable plate 132 away from engagement with the rail 70. The slidable plate 132 has a pair of slots 138 in which suitable bolts 140 having suitable spacers (not shown) are seated into the bottom of the extension 52 so that the plate 132 can move toward and away from the slide element 80. The slidable plate 132 has an inclined end surface 142 against which the end of a threaded shaft 144 can bear, with the threaded shaft 144 engaging a threaded opening in a support block 146 that is attached to the surface extension 54 with bolts 148. A knob 150 can be used by an operator to selectively lock and unlock the fence to position it in a desired location or to slide the fence 50 along the rail 70.

The second preferred embodiment of the present invention utilizes a different mechanism that takes the place of a slide element 80 and a clamping mechanism that is different from the clamping mechanism 130. In this regard, and referring to FIGS. 9, 10 and 11, the mechanism includes a number of rotatable slotted rollers, including lower rollers 152 which engage the lower extension 76 of the rail 70 and a pair of upper rollers 154 that are positioned to engage the upper extension 74 of the rail 70. While the number of rollers and their configuration may be other than that shown, the disclosed configuration provides the necessary support and ease of sliding movement.

Figure 10:
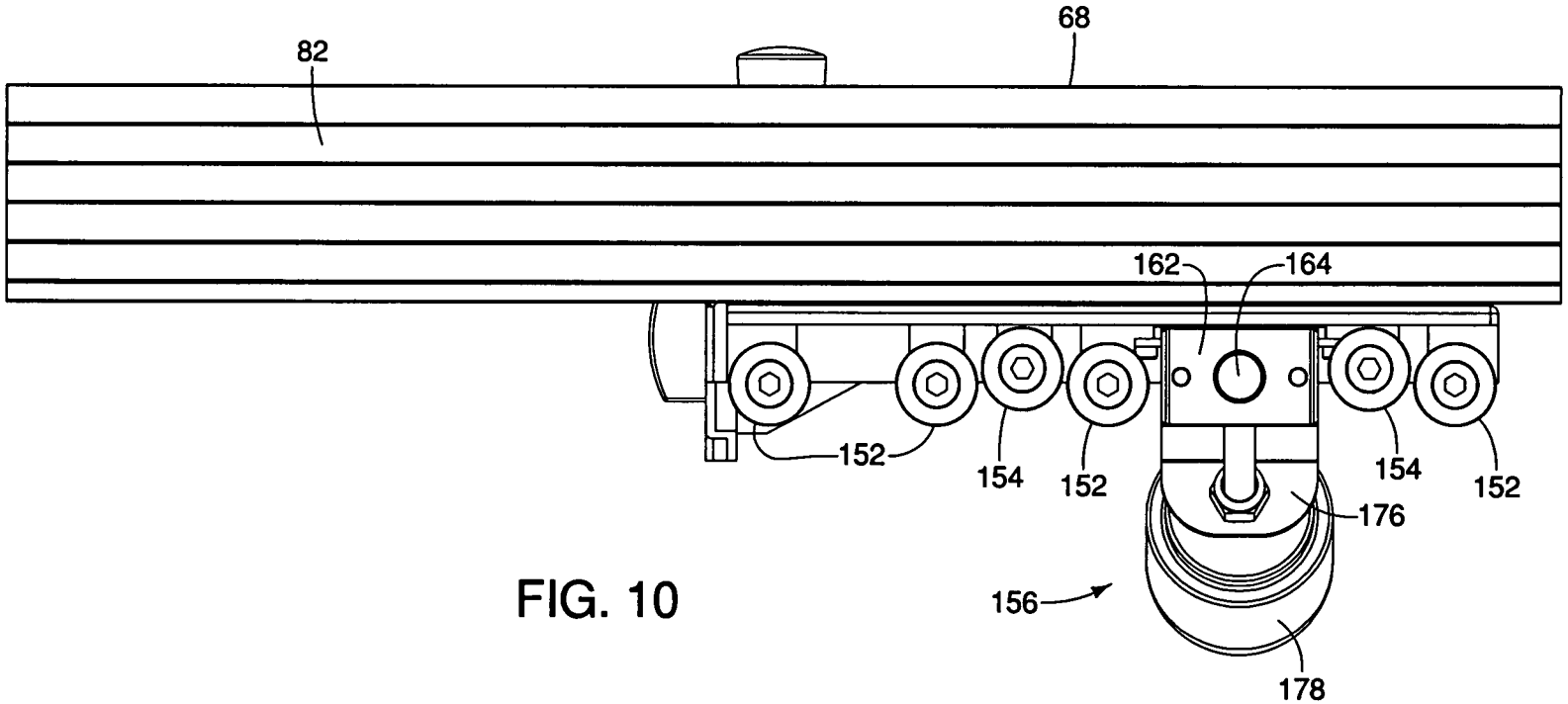
FIG. 10 is a side view of the second preferred embodiment shown in FIG. 9.

A clamping mechanism for this embodiment is indicated generally at 156 and is shown in FIGS. 9-11 to have a clamping block 158 that has an outer surface 160 which cooperates with a short slide element segment 162 that has a cross section that is substantially similar to the cross section of the slide element 80 of the first preferred embodiment. A bolt 164 having a threaded end portion 166 is threadably engaged with a rotatable threaded sleeve 168 which is rotatable within a suitable aperture in the block 158 and which has a preferably hexagonal recess 170 in which a complimentary configured end 172 of a shaft 174 is rotatably mounted in a mounting bracket 176. It should be understood that other complimentary configurations could be used.

The outer end of the shaft 174 is secured to a knob 178 so that selective rotation of the knob 178 causes the shaft to rotate the sleeve 168 and cause the bolt 164 to draw the slide element segment 162 into locking engagement or disengagement. Since the action of the clamping mechanism positively moves the slide element segment 162 in either direction, a spring is unnecessary with this configuration.

The fence member 68 may be provided with a pivotable stop element as shown in FIG. 4 at the right end of the fence member 68. The element is shown in its retracted position wherein a front face 182 does not extend beyond the front face 82 of the fence member 68. However, it is preferably pivotable by a suitable pivoting attachment so that it can be rotated approximately 90° from that shown in FIG. 4 in the counterclockwise direction so that the upper end portion 184 extends beyond the front face 82 of the fence member 68 and thereby defines a stop position which can be used to precisely locate an end of a work piece that may be placed on the table top. If the lateral position of the end is determined to make an appropriate cut, an operator may use such a stop element to rapidly and efficiently make successive cuts on multiple work pieces. It should be understood that such a stop element 180 may be provided at the opposite end of the fence member 68. The exact manner in which the pivoting connection is made may include an appropriate insert that fits within an appropriate portion of the extruded fence member as is known to one of ordinary skill in the art.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A fence mechanism for a push-pull power saw having a table top with generally vertical front, rear and opposite side surfaces, at least one side surface having a captive groove extending from a front portion toward said rear surface, a rotatable blade extending through an elongated slot in the table top and mounted in a carriage mechanism wherein an operator knob is configured to pull the blade from a rearward position in the slot toward the front of the saw to cut a work piece that is positioned on the top surface of the table, said fence mechanism comprising:

a body portion having a holding mechanism for releasably holding an elongated fence assembly slidably attached to said body portion, and including a table extension having a top surface area adapted to be coextensive with said saw table top and configured to be connected to said body portion, said table extension extending beyond a side of the table top;

an elongated fence member slidably attached to said fence assembly and having a generally vertical front planar surface for engaging a work piece;

said table extension having a slide element configured to slidably engage the captive groove, so that said table extension is supported to be coextensive with said saw table top, entirely by the engagement of said slide element with said captive groove;

a locking mechanism for locking said table extension at any desired position along an entire length of the captive groove from the front surface to the rear surface, so that said fence assembly is locked at any desired position along at least the entire length of the captive groove from the front surface to the rear surface, and for unlocking said table extension so that fence assembly is guided along the captive groove toward and in parallel to the blade to move the work piece along the table top to engage the blade for making a cut.

2. A fence as defined in claim 1 wherein one of said desired positions enables said fence to be moved to the front of the saw so that the front planar surface is forward of the vertical front surface.

3. A fence as defined in claim 1 wherein said elongated fence assembly is configured to releasably clamp said elongated fence to thereby permit said fence to be slidably adjusted thereon.

4. A fence as defined in claim 3 wherein said elongated fence assembly is configured to horizontally rotate said elongated fence to thereby permit said fence to be oriented at various miter angles.

5. A fence as defined in claim 4 wherein said elongated fence assembly comprises an elongated rail member, a non-rotating miter base attached to said rail member, and a miter frame rotatably mounted on said miter base, said miter frame being configured to slidably secure said elongated fence member thereto.

6. A fence as defined in claim 5 wherein said elongated fence assembly further comprises a detent mechanism which releasibly retains said miter frame and elongated fence member at any selected one of various predetermined angular positions.

7. A fence as defined in claim 6 wherein said fence assembly has a center axis which connects said miter base and rotating miter frame together, said detent mechanism being configured to interact between said miter base and rotating miter frame.

8. A fence as defined in claim 7 wherein said detent mechanism comprises depressions located in the underside of said rotatable miter frame for receiving a ball mounted in said miter base and biased upwardly into contact with said underside of said rotatable miter frame.

9. A fence as defined in claim 8 wherein said body portion further comprises a detent mechanism override for selectively disabling said detent mechanism.

10. A fence as defined in claim 9 wherein said detent mechanism override is a glide lever slidably mounted on the top of said rail member and configured to selectively engage said ball and prevent it from contacting said underside of said rotatable miter frame.

11. A fence as defined in claim 5 wherein said elongated fence assembly further comprises a miter clamp for locking said rotatable miter frame in a desired angular position and a fence clamp for locking said slidable elongated fence member at a desired position.

12. A fence as defined in claim 5 wherein said miter base further comprises a miter gauge having indicia indicating the angular position of said miter frame, said miter frame having a surface that aligns with said angular position indicia when said miter frame is rotated on said center axis.

13. A fence as defined in claim 1 wherein the captive groove in the saw comprises a side portion having a vertical groove with a main opening, upper and lower undercuts that are formed in said table side surface, said slide element riding within the groove and having portions which engage at least the inside surface of said upper and lower undercuts to securely hold the fence.

14. A fence as defined in claim 13 wherein said slide element further comprises an engagable clamping mechanism that selectively locks said slide element in a desired position when engaged and permits sliding movement of the fence when disengaged.

15. A fence as defined in claim 13 wherein said slide element has a cross sectional configuration that substantially fills the vertical groove and has vertical extensions that are coextensive with the inside surfaces of said upper and lower undercuts.

16. A fence as defined in claim 1 wherein said slide element is comprised of a plastic material that is attached to said table extension.

17. A fence as defined in claim 1 wherein said slide element comprises an elongated element in which a plurality of rotatable wheels having an outer peripheral surface with a slot for engaging the portions which define said undercuts, some of said wheels engaging said upper portions which define said upper undercut, and some of said wheels engaging said lower portions which define said lower undercut, said wheels providing support for said slide element at its upper and lower extent.

18. A fence as defined in claim 1 wherein said engagable clamping mechanism comprises a rotatable knob operatively connected to a clamping plate that is positioned adjacent said slide element and moves said clamping plate relative to said slide element to hold the same in the groove.

19. A fence as defined in claim 1 wherein said elongated fence member further comprises a stop element mounted thereto, which is rotatable between an operative position and a non-operative position, said stop element extending in front of said elongated fence member when in an operative position so that a work piece can abut said stop element when rotated into said operative position.

20. A fence as defined in claim 1 wherein stop element is provided on either end thereof.

21. A fence as defined in claim 1 wherein the table top side portion comprises an extrusion attached thereto which includes said groove.

22. A push-pull power saw comprising:

a table top with generally vertical front, rear and opposite side surfaces, at least one side surface having an elongated side element extending from a front portion toward said rear surface, said side element having a cross section defining a vertical groove with an inner vertical surface that merge into upper and lower opposed extensions that define upper and lower undercuts;

a rotatable blade extending through an elongated slot in the table top and mounted in a carriage mechanism wherein an operator knob is configured to pull the blade from a rearward position in the slot toward the front of the saw to cut a work piece that is positioned on the top surface of the table; and a fence mechanism comprising, an elongated fence member having a generally vertical front planar surface for engaging a work piece;

a table extension having a top surface area coextensive with said saw table top and operatively connected to said fence member, said extension extending beyond a side of the table top surface, said table extension further having a slide element configured to slidably engage the side element of the side surface on the table top, so that said table extension is supported to be coextensive with said saw table top, entirely by the engagement of said slide element with said side element;

said fence member being configured so that the front planar surface can be positioned forward of the vertical front surface of the saw; and a locking mechanism for locking said table extension at any desired position along an entire length of the side element from the front surface to the rear surface, so that said fence assembly is locked at any desired position along at least the entire length of the side element from the front surface to the rear surface and for unlocking said table extension so that fence assembly is guided along the side element toward and in parallel to the blade to move the work piece along the table top to engage the blade for making a cut.

* * * * *

UNITED STATES PATENT AND TRADEMARK OFFICE

CERTIFICATE OF CORRECTION

PATENT NO. : 8,424,434 B2
APPLICATION NO. : 12/431328
DATED : April 23, 2013
INVENTOR(S) : Koegel et al.

It is certified that error appears in the above-identified patent and that said Letters Patent is hereby corrected as shown below:

In the Claims

Claim 2, line 2 (col. 7, line 44):

Replace "said fence to be" with -- said fence assembly to be --

Signed and Sealed this
Seventh Day of January, 2014

Margaret A. Focarino

Margaret A. Focarino
*Commissioner for Patents of the United States Patent and Trademark Office*